United States Patent [19]

Ryaa

[11] 4,430,826

[45] Feb. 14, 1984

[54] CONNECTING DEVICE FOR ADJUSTABLY AND DETACHABLY INTERCONNECTING A PLURALITY OF ELONGATED BUILDING COMPONENTS

[75] Inventor: Jan Ryaa, Billund, Denmark

[73] Assignee: Interlego A.G., Baar, Switzerland

[21] Appl. No.: 324,088

[22] Filed: Nov. 23, 1981

[30] Foreign Application Priority Data

Nov. 25, 1980 [DK] Denmark ..... 5010/80

[51] Int. Cl.[3] ..... A63H 33/10; F16B 7/10

[52] U.S. Cl. ..... 46/29; 403/64; 403/97

[58] Field of Search ..... 46/23, 28, 29; 403/64, 403/84, 91, 97; 285/68, 69

[56] References Cited

U.S. PATENT DOCUMENTS

| | | | |
|---|---|---|---|
| 584,705 | 6/1897 | Redfern | 285/68 |
| 1,307,160 | 6/1919 | Stokes | 403/97 |
| 1,860,627 | 5/1932 | Sherman | 46/29 |
| 1,996,722 | 4/1935 | Gilbert et al. | 46/29 |
| 3,230,643 | 1/1966 | Mathus | 46/29 X |
| 3,495,857 | 2/1970 | Hawke et al. | 403/97 X |
| 3,638,352 | 2/1972 | Christiansen | 46/23 |
| 3,699,709 | 10/1972 | Schmidt | 46/28 X |

FOREIGN PATENT DOCUMENTS

| | | |
|---|---|---|
| 117131 | 3/1970 | Denmark . |
| 2537539 | 3/1976 | Fed. Rep. of Germany . |
| 312510 | 12/1969 | Sweden . |
| 408134 | 2/1979 | Sweden . |
| 456421 | 7/1968 | Switzerland . |
| 477212 | 10/1969 | Switzerland . |

*Primary Examiner*—F. Barry Shay

*Attorney, Agent, or Firm*—Kane, Dalsimer, Kane, Sullivan and Kurucz

[57] ABSTRACT

A connecting device for a toy building set includes two identical connectors, each comprising a primary tubular sleeve having a toothed rim on one end face and a secondary tubular sleeve integral with the surface of the primary sleeve. The secondary sleeve is disposed at right angles to the primary sleeve with one end face adjacent the toothed end face of the primary sleeve. The sleeves have a circular cross-section permitting rotation about a shaft, but rotation is prevented by a pair of stop rings which are frictionally and slidably mounted on the shaft and serve to clamp the sleeves together. When assembled, the two connectors are interlocked by meshing of the toothed rims.

10 Claims, 6 Drawing Figures

Figure 2:
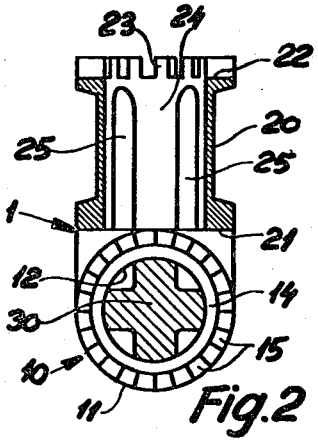

CONNECTING DEVICE FOR ADJUSTABLY AND DETACHABLY INTERCONNECTING A PLURALITY OF ELONGATED BUILDING COMPONENTS

This invention generally relates to means for adjustably and detachably interconnecting a plurality of elongated components and, more particularly, to a device comprising a pair of connectors for assembling shafts and rods in a toy building set in a large number of different angular positions relatively to one another for building spatial structures of various configurations, such as grids or the like.

The main object of the invention is to provide a compact connecting device, the components of which are a pair of tubular connectors of relatively small dimensions, and which can readily be assembled with and detached from the elongated components of a toy building set. Moreover, it is also a general object of the invention to enable the connectors to be adjusted and interlocked in any desired relative position and to be made by moulding thermoplastic materials by means of relatively simple and inexpensive moulds.

Prior art in this field comprises coupling devices having pairs of connecting members disposed rotatably relatively to one another and including tubular means for inserting the ends of elongated components in different angular positions. A device of this type is described in the German Offenlegungsschrift No. 2,537,539. The connectors of this device are of widely different shapes, they are relatively voluminous and they require the use of different and bulky moulds for their manufacture. Moreover, they are not very handy for children to build diversified spatial structures of a vast number of configurations. These shortcomings are overcome by the connecting means of this invention.

According to this invention, there is provided a connecting device including a pair of connectors for adjustably and detachably interconnecting a plurality of elongated building components in different angular positions, in particular shafts and rods in a toy building set, and this device is characterized in that each of the connectors comprises a pair of integral tubular members, disposed at a right angle relatively to one another, and including a primary sleeve having a substantially cylindrical surface and a pair of end faces, one of which is provided with a toothed rim, and a secondary sleeve, having a pair of end faces, one of which is integral with the surface of the primary sleeve.

The shape of the two connectors may differ slightly from one another, but in a preferred embodiment of the invention they are identical, which affords the essential advantage that only one mould will be required for their manufacture.

Also, in the preferred embodiment of a connector according to the invention, the end face of the secondary sleeve which is remote from the primary sleeve may be provided with a toothed rim adapted to mesh with the toothed rim of an adjacent primary sleeve, so as to increase the possibilities of interconnecting rods and shafts in a building set.

Another feature of a connector according to the invention which provides for a compact design of the connecting device is characterized in that the plane of the toothed rim on the end face of the primary sleeve coincides with the axis of the secondary sleeve.

The two sleeves of a connector according to the invention may have different lengths, and in a further embodiment of the invention the primary sleeve is shorter than, preferably half as long as the secondary sleeve. This also contributes to a more compact design of the connecting device.

So as to provide for a rigid non-rotatable connection between a connector and the end of a splined shaft inserted therein, the bore of one of the sleeves may have a non-circular cross section for non-rotatably mounting one end of the shaft having a complementary non-circular cross section.

As will be described more particularly with reference to the drawings, the two connectors of the connecting device may be assembled in any desired angular position by meshing the teeth of their primary sleeves, and in this position they may be interlocked by interlocking means which, according to the invention, comprises a tubular, resilient and compressible plug for interlocking the connectors when inserted in the ends of their adjacent, co-axially disposed primary sleeves.

Finally, the invention comprises a component for the connecting device, and this component is a stop ring characterized by having a non-circular cross section adapted to provide a frictional fit between the ring and a splined shaft having a complementary cross section.

According to the invention, one end face of the stop ring may be provided with a toothed rim for meshing with an identical toothed rim on one end of the end faces of an adjacent connector.

Figure 1:
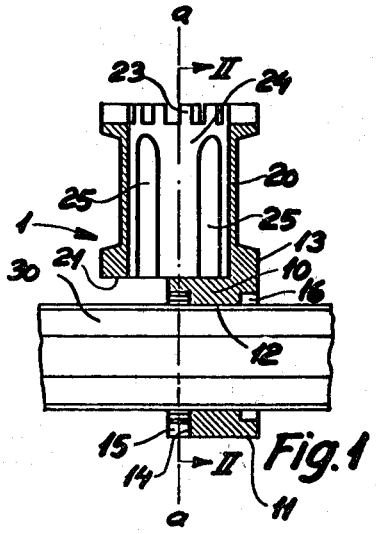
Figure 3:
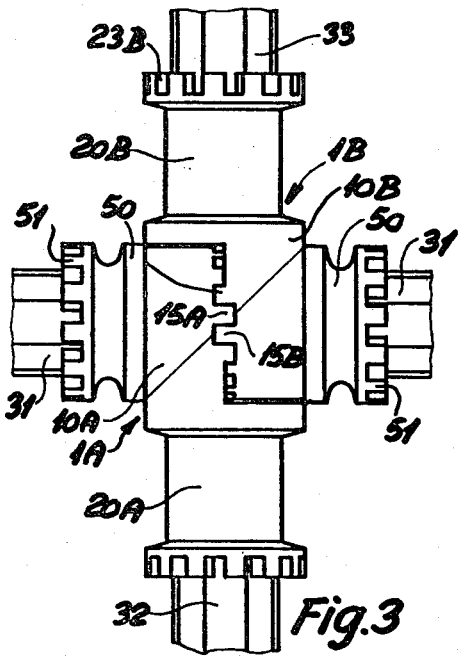
Figure 4:
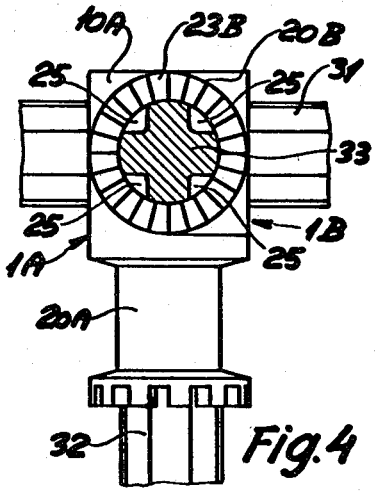
Figure 5:
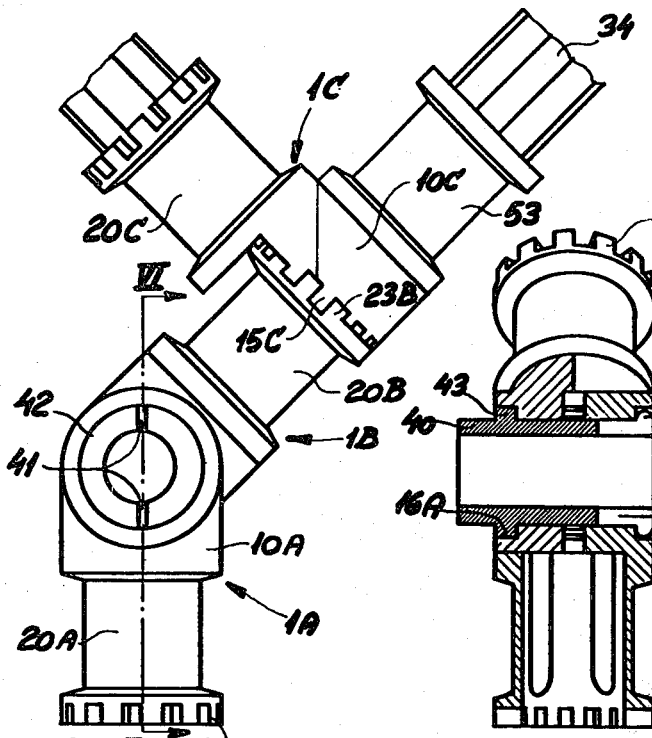
Figure 6:
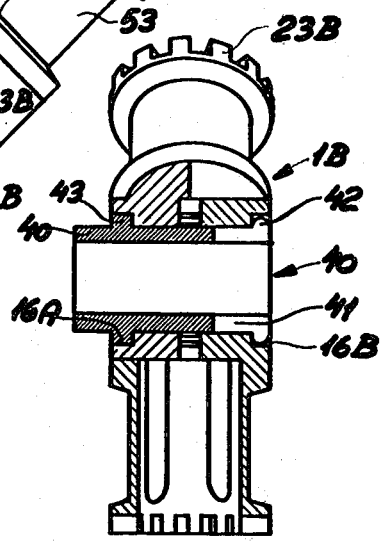

The object of providing a childproof and simplified connecting device, as briefly summarized above, has been achieved by the combination of the features set forth in the claims and explained in details with reference to the preferred embodiments illustrated in the drawings, wherein FIG. 1 is an axial sectional view showing a connector according to the invention, FIG. 2 is an axial sectional view taken on the line II—II of FIG. 1, FIG. 3 is an elevation showing a connecting device comprising a pair of interconnected connectors, FIG. 4 is a similar elevation showing one end face of one connector which is disposed at right angle relatively to the other connector, FIG. 5 is a side elevation showing a structure including a pair of connectors disposed and interlocked at an angle of 135° relatively to one another and a third connector disposed at a right angle relatively to one of them, and FIG. 6 is a sectional view taken on the line VI—VI in FIG. 5.

Referring to the drawings and, more particularly, to FIGS. 1 and 2 thereof, it will be seen that the connector comprises a pair of integral, tubular members disposed at right angle relatively to one another. They will hereinafter be referred to as the primary sleeve 10 and the secondary sleeve 20.

The primary sleeve 10 has a cylindrical surface 11, which is integral with an adjacent end face of the secondary sleeve 20, and comprises a cylindrical aperture 12 and a pair of end faces 13 and 14. The end face 14 has a plurality of axially extending projections which, in the preferred embodiment shown in the drawings, are shaped as teeth in a toothed rim 15 disposed co-axially with the end face 14. In the other end face 13 there is provided an annular recess 16.

The secondary sleeve 20 comprises one end face 21, which is integral with the cylindrical surface 11 of the primary sleeve, and another end face 22 having a toothed rim 23 for engagement with the rim 15 of an adjacent primary sleeve. Moreover, the inner wall of the cylindrical aperture 24 of the secondary sleeve 20 comprises four lengthwise extending ribs 25 providing for a non-circular cross section of this sleeve.

In the preferred embodiment of the connector shown in FIGS. 1 and 2, which is generally designated as 1, the length of the primary sleeve 10 is approximately one half of the length of the secondary sleeve 20, and the relative positions of the two sleeves is such that the plane of the rim 15 at the end face 14 of the primary sleeve 10 coincides with the axis a-a of the secondary sleeve. This arrangement provides for a minimum width of a connecting device consisting of two connectors which are interconnected by meshing the teeth of their primary sleeves.

In principle, the elongated components designated to be assembled by inserting their ends in the sleeves of a connecting device according to the invention may have any desired cross section which provides for a frictional fit between their ends and the apertures of the sleeves. However, in the preferred embodiment here described, they are splined shafts, as described in U.S. Pat. No. 3,638,352, provided with four lengthwise extending grooves forming between them four ridges or beads, so as to provide for a cross-shaped cross section which is complementary to the cross section of the secondary sleeves 20 defined by the ribs 25. Furthermore, the relative dimensions of the shafts and sleeves are such as to provide for a frictional fit between the ends of the shafts and the secondary sleeves 20.

On the other hand, the internal diameter of the primary sleeve 10 is slightly larger than the diameter of the shaft, so as to allow this sleeve and hence the connector 1 to be mounted rotatably and slideably on the shaft. This arrangement is illustrated in FIGS. 1 and 2 showing the primary sleeve 10 rotatably mounted on a splined shaft 30.

Referring now to FIG. 3, there is shown a connecting device comprising two connectors 1A and 1B which are interconnected by meshing the teeth of the rims 15A and 15B on their primary sleeves 10A and 10B in a position wherein the secondary sleeves 20A and 20B are in alignment with one another, i.e. in an angular position of 180°. The assembled primary sleeves 10A and 10B are mounted on a shaft 31 and would be rotatable around this shaft, if they were not firmly clamped together by a pair of stop rings 50 frictionally and slideably, but non-rotatably mounted on the shaft 31. The cross section of the stop rings 50 is complementary to the cross section of the shaft 31, and one of their end faces is provided with a toothed rim 51 adapted to mesh with the toothed rim 15 or 23 of an adjacent primary or secondary sleeve. It will be understood that the provision of these stop rings is essential for clamping the rims 15A and 15B firmly together in a predetermined angular position, so as to prevent disengagement of the interconnected connectors. Other shafts 32 and 33 are mounted non-rotatably in the secondary sleeves 20A and 20B and may be used for mounting other connectors.

In FIG. 4 there is shown a similar combination wherein the two connectors are disposed at a right angle relatively to one another and the two stop rings have been omitted. In this figure, the cross section of the secondary sleeve 20B, which is perpendicular to the secondary sleeve 20A, shows the four ribs 25 and the cross section of the shaft 33 inserted therein.

Finally, FIGS. 5 and 6 show a structure including a pair of connectors 1A and 1B assembled in the same manner as explained with reference to FIGS. 3 and 4 and interlocked in an angular position of about 135°. In this structure the toothed rim 23B of the secondary sleeve 20B is meshed with the toothed rim 15C of the primary sleeve 10C of a third connector 1C disposed at a right angle relatively to the connector 1B. The connectors 1B and 1C are assembled on a shaft 34 inserted in the secondary sleeve 20B and extending through the primary sleeve 10C of the connector 1C. They are clamped together by a tubular member 53 similar to the stop rings 50 of FIG. 3.

The connectors 1A and 1B are interlocked in the position shown in FIG. 5 by means of a tubular, resilient and compressible plug 40 provided with a pair of slits 41 and a pair of annular end flanges 42 at one end thereof. The plug 40 further comprises an annular flange 43 disposed at a short distance from the other end of the plug. When inserted in apertures 12 of the co-axially disposed primary sleeves of the connectors 1A and 1B, the semi-circular end flanges 42 will engage the annular recess 16B in one of the primary sleeves 10B, and the other annual flange 43 will engage the annular recess 16A of the other primary sleeve 10A. Due to the elasticity of the plug 40 and the compressibility provided by the slits 41 the two connectors will be firmly interlocked in the angular position determined by the relative position in which the teeth of their toothed rims 15 mesh with one another.

It will be understood that the invention is by no means limited to the above described, preferred embodiment, but that the details of the components of the connecting device and in particular the shape of the primary and secondary sleeves may be varied in many ways within the scope of the features defined in the claims.

I claim:

1. A connecting device for adjustably and detachably interconnecting pairs of elongated building components in a toy building set and including a pair of connectors, each of which comprises a first tubular member, the primary sleeve, adapted to receive said components at respective ends having a substantially cylindrical external surface and a pair of annular end faces, one of said end faces being provided with a plurality of axially extended projections for engagement with complementary projections on an adjacent connector, and a second tubular member, the secondary sleeve, adapted to receive said components at respective ends, disposed at a right angle relatively to the primary sleeve and having a pair of end faces, one of said end faces being integral with the cylindrical surface of the primary sleeve and means for clamping said connectors in said relationship.

2. A device according to claim 1, wherein the two connectors are identical.

3. A device, as claimed in claim 1, wherein the axially extending projections on one end face of each primary sleeve define a toothed rim.

4. A connector for a coupling device, as claimed in claims 1 or 2, wherein the end face of the secondary sleeve, which is remote from the primary sleeve, is provided with a toothed rim adapted to mesh with the toothed rim of an adjacent primary sleeve.

5. A connector for a coupling device, as claimed in claims 1 or 2, wherein the plane of the toothed rim on the end face of the primary sleeve coincides with the axis of the secondary sleeve.

6. A connector, as claimed in claim 2, wherein the primary sleeve is shorter than, preferably half as long as the secondary sleeve.

7. A connector, as claimed in claim 6, wherein the cavity of one of the sleeves has a non-circular cross section for non-rotatably mounting one end of a splined shaft having a complementary non-circular cross section.

8. A device, as claimed in claim 1, in which the two connectors are assembled by meshing the teeth of their primary sleeves, clamping means comprising a tubular, resilient and compressible plug for interlocking the connectors when inserted in the ends of their adjacent, co-axially disposed primary sleeves.

9. A device, as claimed in claim 1, wherein said clamping means includes a stop ring having a non-circular cross section adapted to provide a frictional fit between the ring and a splined shaft having a complementary cross section.

10. A device, as claimed in claim 9, wherein one end face of the ring is provided with a toothed rim.

* * * * *